United States Patent [19]

Rosen et al.

[11] 4,077,441

[45] Mar. 7, 1978

[54] CONVERTIBLE FILLING MACHINE

[75] Inventors: Sidney Rosen, Baltimore; Richard Nelson Bennett, Arbutus, both of Md.

[73] Assignee: National Instrument Company, Baltimore, Md.

[21] Appl. No.: 714,903

[22] Filed: Aug. 16, 1976

[51] Int. Cl.[2] ..... B65B 3/04

[52] U.S. Cl. ..... 141/1; 53/201; 141/84; 417/238; 417/521

[58] Field of Search ..... 53/201; 141/1, 84, 98, 141/99, 138, 155, 178, 180, 183, 184, 186, 191, 231, 234, 235, 237, 392; 417/238, 521

[56] References Cited

U.S. PATENT DOCUMENTS 3,911,976 10/1975 Rosen ..... 141/84

3,939,883 2/1976 Harrell et al. ..... 141/231

*Primary Examiner*—Richard E. Aegerter

*Assistant Examiner*—Frederick R. Schmidt

*Attorney, Agent, or Firm*—Craig & Antonelli

[57] ABSTRACT

A filling machine which in its original construction includes a first number of filling units and which is adapted to be converted into a filling machine with a second number of filling units greater than the first number; to that end the actuating drives of two filling units on the same side of the machine are interconnected by the use of a linking bar detachably mounted over the eccentrics thereof while bearing sleeve housings and bearing bushings are detachably secured on the linking bar in a predetermined number and at predetermined locations for installing thereon the lower ends of the filling units; the pump post mounting members for the upper ends of the respective filling units are removed and in lieu thereof an upper mounting bar is fastened to the filling machine by the use of the same threaded holes in the filling machine which were originally used for fastening the pump post mounting members; the upper mounting bar is provided with a number of pump post members detachably secured thereto which correspond in number to the predetermined number and which are so located on the mounting bar that the upper ends of the filling units can be pivotally secured thereon.

19 Claims, 3 Drawing Figures

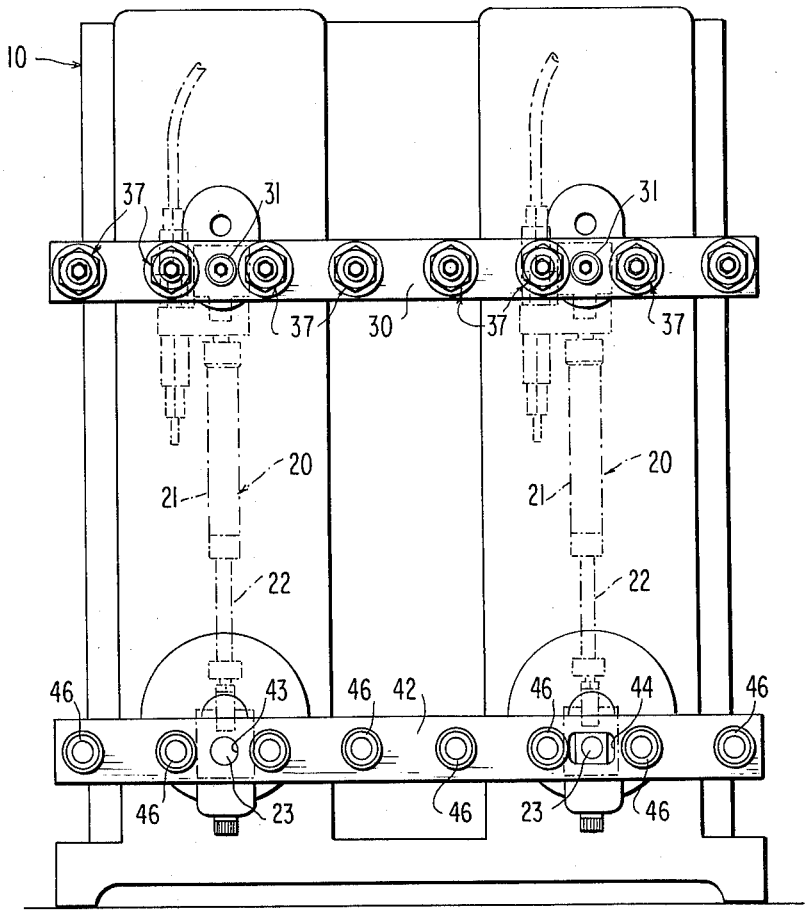
FIG. 2
FIG. 3
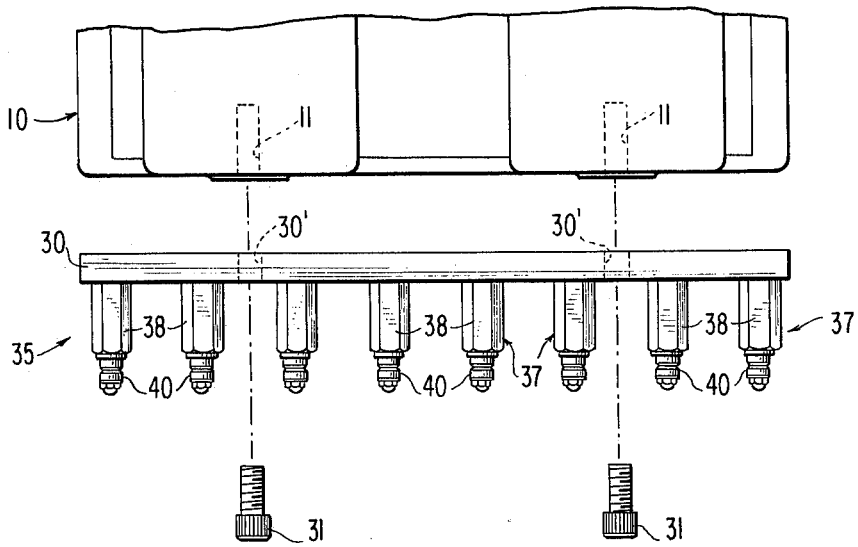

CONVERTIBLE FILLING MACHINE

The present invention relates to a high speed filling machine for simultaneously filling a given number of containers each with a predetermined amount of a product, and more particularly to a filling machine which can be readily converted with respect to the number of containers to be simultaneously filled.

Filling machines in which small containers such as bottles, ampoules, etc. conveyed on an endless conveyor band are to be simultaneously filled from nozzles adapted to be lowered into the containers, are known in the art. For example, the prior U.S. Pat. No. 2,807,213 describes such a filling machine. Since the endless conveyor band normally runs continuously, some indexing system is required to hold the number of containers which are to be filled simultaneously, stationary underneath the nozzle while the product is discharged out of the lowered nozzles. Various types of indexing systems have been used heretofore in the prior art as exemplified by the U.S. Pat. Nos. 3,067,768 and 3,237,661 which were of the electromechanical type and were generally suited to index only the predetermined number of containers for which the machine was originally designed without the possibility to readily change such number.

The filling machines with the indexing systems of the type described above were normally offered to the customer standardized with respect to the number of pumps and filling nozzles installed on the filling machine at the factory. This meant that the number of containers which could be filled simultaneously by these prior art filling machines was determined beforehand by the number of pumps and nozzles with which the machine came originally equipped. Since this number could not be readily changed, the customer was limited in the number of containers which could be simultaneously filled by a given type of filling machine. To the extent the indexing system so permitted, which was by no means the normal situation, the number of containers which could be simultaneously filled by these prior art filling machines could only be reduced by failing to utilize one or more of the pumps and nozzle structures; however, this number could not be increased without major changes in the filling machines and their various systems. Since the cost of the filling machines normally increases with the number of filling units supplied with the equipment, customers are reluctant to invest a greater amount than necessary and therefore select that type of machine which offers lowest initial investment compatible with the normal intended use of the filling machine. Insufficient versatility on the part of the filling machines of the aforementioned type has always been a drawback which was keenly felt in the industry. This lack of versatility applied both to the different shapes of the containers which could be filled by the machine as also to the number of containers which could be simultaneously filled. Consequently, to improve the versatility of the prior art filling machines, two principal areas required improvements and solutions, namely, on the one hand, the area of the indexing systems to permit a quick and easy conversion of the filling machine from one type of container to another and/or from one number of containers to be simultaneously filled to another number thereof and, on the other, the area of readily converting the machine from a number of filling units as originally supplied with the machine to a greater number of such filling units without any major change in the machine.

The problems as regards indexing systems have been solved by recent innovations which permit a ready change by simple means of the shape and/or number of containers to be simultaneously filled, as described, for example, in the copending applications Ser. No. 512,351 entitled "Fluid Filling Machine" filed on Oct. 4, 1974, and Ser. No. 708,635 entitled "Star-Wheel Indexing System for Automatic Filling Machines" filed on July 26, 1976. On the other hand, no solution existed for the heretofor commercially available filling machines as regards the problem with respect to changing the number of filling units, i.e., of pump units and filling nozzles, by simple means to conform to the number of containers to be simultaneously filled at a given time. The present invention is concerned with the task to eliminate these shortcomings and drawbacks encountered in the prior art and to provide a filling machine which can be readily adapted to fill simultaneously different numbers of containers without any major modification in the equipment as originally delivered.

The underlying problems are solved according to the present invention by certain attachments which can be readily installed on an existing filling machine of the type described above and which permit an increase in the number of filling units, i.e., of pump units and filling nozzles connected with the pump units, with a relatively large latitude and without requiring any change in any other part of the filling machine, such as in the electrical system, in the drive system, or in the mechanical construction thereof. More specifically, the parts used for converting, for example, a two or four pump machine into an eight or sixteen pump machine involve, in principle, for each two pre-existing filling units only two bars with suitable fastening means, one of the two bars being secured at the machine housing to pivotally support thereon the relatively fixed ends of the pumps and the other being mounted over the pre-existing eccentric pump actuating drive pins to provide a common drive for the increased number of the filling units to be driven thereby.

In one particular embodiment of a four-pump filling machine with two filling units each located on opposite sides of the housing of the filling machine, two sets of bars are used for each side of the housing of the filling machine, which may provide for any greater number of filling units to be mounted on the machine and to be simultaneously actuated thereby, as desired.

The present invention thus offers the significant advantage that the customer need not buy a filling machine with excess capacity, yet is able to convert the original filling machine into a filling machine capable of simultaneously filling a larger number of containers than originally contemplated, when the need arises.

A further significant advantage of the present invention resides in the fact that the relatively few parts required for the conversion of the machine can be subsequently acquired by the customer in the form of a conversion kit which requires no skill on the part of the person using the same, yet permits easy installation thereof while assuring proper operation of each filling unit. It has been found surprisingly that the volume dispensed with by each pump is substantially equal if filling units with identical bore sizes are selected. Moreover, the accuracy of the dispensed volume can be further enhanced, if so desired, by the use of a valve system as disclosed in the copending applications Ser.

No. 609,541 entitled "Valve System for Filling Machines" and filed in the U.S. Patent and Trademark Office on Sept. 23, 1975, and Ser. No. 694,920 entitled "Filling Unit with Air-Operated Spool Valve" and filed on June 11, 1976, which provide effective solutions to the problem of speed of and accuracy of the amount of product dispensed by the machine.

Accordingly, it is an object of the present invention to provide a filling machine which can be readily changed in the number of containers which can be simultaneously filled therewith.

Another object of the present invention resides in a filling machine which permits the use of different numbers of filling units, depending on the need of the customer, without any changes in the machine itself or its electro-mechanical system.

A further object of the present invention resides in a converter kit which involves relatively few parts, yet permits the filling machine to be increased by extremely simple means as regards the number of filling units which can be simultaneously used with the machine.

A still further object of the present invention resides in a conversion kit for filling machines of the type described above which is easy to install, yet is reliable in operation and does not impair the accuracy of the amount of the metered product.

Still a further object of the present invention resides in a conversion kit for filling machines of the type described above which requires no change whatsoever in the construction of the machine.

These and further objects, features and advantages of the present invention will become more apparent from the following description when taken in connection with the accompanying drawing which shows, for purposes of illustration only, one embodiment in accordance with the present invention, and wherein:

FIG. 2 is a left side elevational view of the filling machine of FIG. 1, and FIG. 3 is a partial exploded top plan view of the right side of the filling machine of FIG. 1.

Figure 1:
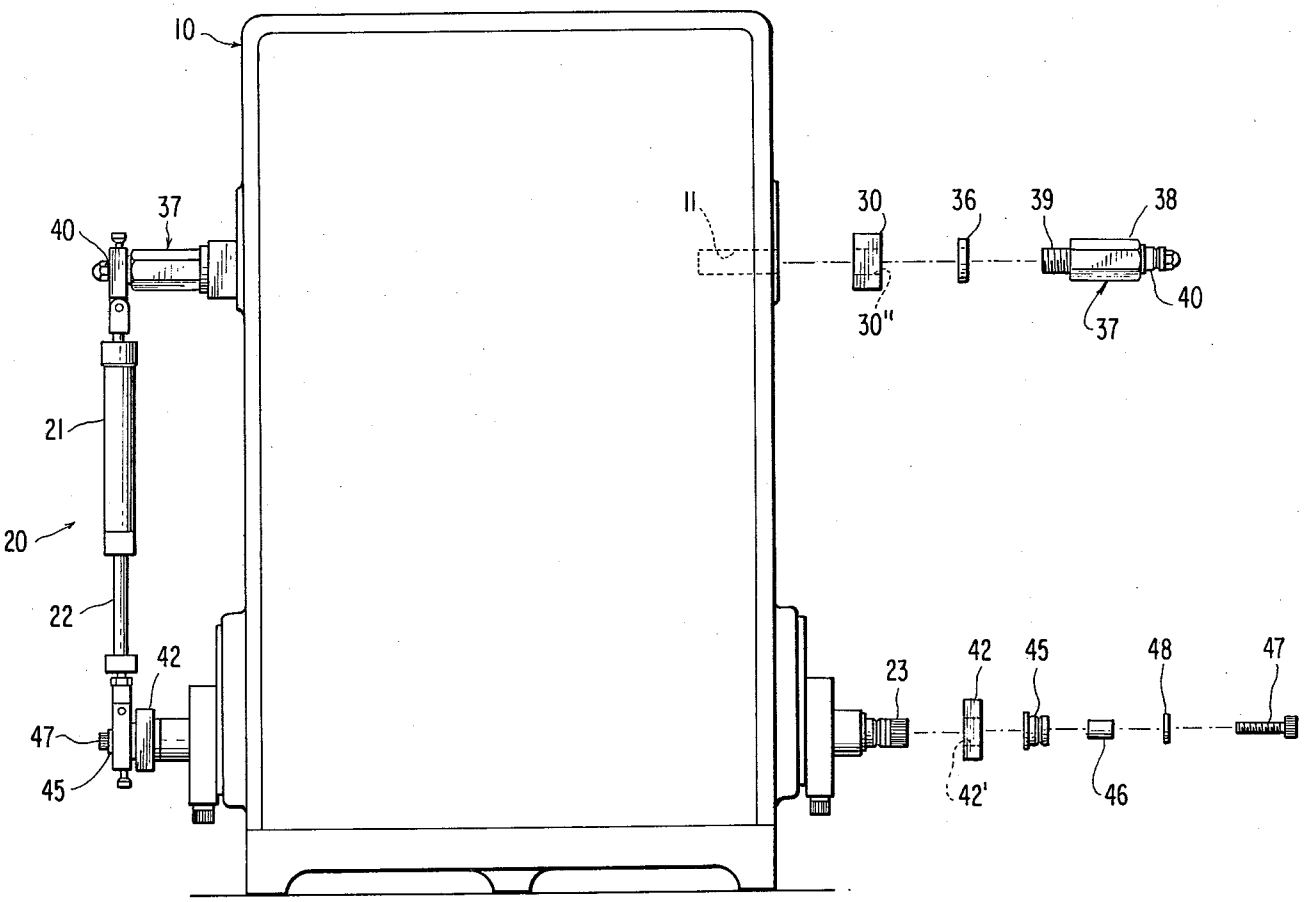
FIG. 1 is an elevational view of a four pump filling machine, showing on the right side thereof, in exploded view, the parts to be installed for purposes of converting the machine into a sixteen pump unit and on the left side thereof, the parts as installed to convert the filling machine into a sixteen pump filling machine.

Referring now to the drawing wherein like reference numerals are used throughout the various views to designate like parts, reference numeral 10 generally designates a filling machine of any conventional construction which, in the illustrated embodiment, is a four filling unit machine. Since the filling machine, as such, is of conventional construction, only the parts essential to the present invention are illustrated herein whereas all other parts which do not form part of the present invention such as nozzles, nozzle holders, indexing system, electric drive, etc. are not illustrated for the sake of clarity.

The filling machine 10 as originally supplied by the manufacturer comprised four filling units generally designated by reference numeral 20 of which two are shown in dash and dotted lines in FIG. 2. As described more fully in the prior U.S. Pat. No. 2,807,213, the cylinder housing 21 of such filling unit 20 is pivotally suspended at its upper end on a pump post mounting arm while the lower end of the piston rod 22 is drivingly connected with the eccentric pin 23 of the corresponding micrometer control drive. The filling unit 20, of course, includes also suitable inlet and discharge connections adapted to be selectively brought into communication with the inside of the pump cylinder 21 by the use of appropriate valves, such as check valves as described in the prior U.S. Pat. No. 2,807,213, or selectively actuated spool valves as described in the aforementioned copending applications Ser. Nos. 609,541 and 694,930 which greatly increase the accuracy with respect to the amount of the discharged product and also permits an increase in filling speed.

The original equipment which included two filling units on each side of the filling machine and driven on each side from two respective eccentric pins 23 of the pump drive mechanisms (not shown), is to be converted, for example, into a sixteen filling unit machine with eight filling units on each side, each containing a pump as well as valved inlet and discharge means, by undertaking the following few modifications with the use of parts conveniently supplied in a converter kit:

The original four pumps are each disconnected in a conventional manner from their respective upper pump post mounting member (not shown) and from their respective eccentric actuating pin 23. Additionally, the original pump post mounting members are screwed out of the threaded bores 11 provided therefor in the machine 10. In lieu thereof, a pump post mounting bar 30 is now detachably fastened to the machine 10 by means of two socket head cap screws 31, utilizing again the same existing threaded bores 11 for this purpose so that no new holes need to be made. A number (8) of upper pump post assemblies generally designated by reference numeral 35 are threadably and detachably secured on the pump post mounting bar 30, preferably before the bar 30 is secured onto the machine 10. For that purpose, the bar 30 is provided with a corresponding number of properly spaced and positioned threaded bores 30'. Each pump post assembly 35 includes, in addition to a washer 36, a pump post element 37 having a polygonal main body portion 38 for engagement with a socket wrench, a threaded end section 39 to be screwed into a corresponding threaded bore 30'' also provided in the bore 30 and a reduced diametric bearing end section 40 for the pivotal connection with the upper part of the cylinder 21, whereby the bearing section 40 corresponds in its construction and dimensions to the corresponding part as used in the original filling machine, so that no changes are required either insofar as the pivotal connections for the upper parts of the cylinders 21 are concerned.

The two eccentric drive pins 23 are then interconnected by means of a link bar 42 which is provided with a circular hole 43 to be mounted over the eccentric drive pin 23 of the actuating drive mechanism of one original pump and with an elongated hole 44 for connection over the eccentric drive pin 23 for the other actuating drive mechanism of the other original pump. The elongated hole 44 prevents binding that might otherwise occur as a result of slight dimensional differences and/or slight differences in the actuating mechanisms. The link bars 42 are thereby held on the eccentric pins 23 by suitable conventional means, such as further washers, etc. (not shown). Additionally, the link bar 42 is provided with a predetermined number of threaded bores 42' for threadably securing thereto a predetermined number (8) of bearing sleeve housings 45 and bearing bushings 46 by the use of socket head cap screws 47 and the interposition of flat washers 48.

As can be seen from FIG. 1, the lower end of a respective piston rod 22 will now be connected with the corresponding bearing sleeve housing 45 and bearing bushing 46 while the upper part of the corresponding cylinder 21 will be mounted over the bearing surface 40 of the corresponding upper pump post member 37.

The foregoing clearly illustrates that by the use of the present invention, a four filling-unit machine can be readily converted, for example, into a sixteen filling-unit machine by extremely simple means whose pumps are all driven in unison on each side by the use of the link bars 42 which drive all of the piston rods 22 of the filling units on the same side in unison. To change the volume dispensed by the filling units, the two preexisting micrometer volume controls on each side are adjusted as described in the prior art U.S. Pat. No. 2,807,213. Admittedly, the ability to individually adjust the volume dispensed by each filling unit is sacrificed, however, it has been found surprisingly that the volume dispensed by each filling unit is equal if filling units with identical bore sizes are selected. Furthermore, the accuracy of the amount dispensed by each filling unit can be further increased by the use of the valve systems as disclosed in the aforementioned copending applications.

Furthermore, the relatively few parts necessary for converting the filling machine can be sold inexpensively in a converter kit which can be purchased by the owner of the machine subsequent to the original acquisition of the machine to fill his then prevailing needs. As can also be readily seen, the present invention requires no modifications in the original equipment, not even the drilling of any additional holes. Additionally, the various parts to be attached to effect the conversion are easy to install and require no skill on the part of the person undertaking the modification, and can be readily removed to reconvert the machine to its original condition. Finally, the present invention greatly increases the versatility of the original filling machine equipment without any substantial subsequent expenditures or modifications requiring skilled personnel or return to the factory for the modification since all connections involved in the conversion are readily detachable conversions, even in the pre-existing equipment.

As to the increase of the number of nozzles, they can be installed on the existing nozzle support structure as shown, for example, in the prior U.S. Pat. No. 3,237,661, or an enlarged slotted bar can be used, if necessary, to mount thereon the nozzles.

While we have shown and described only one embodiment in accordance with the present invention, it is understood that the same is not limited thereto but is susceptible of numerous changes and modifications as known to those skilled in the art. For example, the present invention is not limited to converting a four pump unit into a sixteen pump unit but, of course, can be equally used, for example, with two pump units for converting the same to a number of pump units greater than two, the number being only limited by space conditions and considerations of power requirements for the drive of the various pumps.

Consequently, we do not wish to be limited to the details shown and described herein but intend to cover all such changes and modifications as are encompassed by the scope of the appended claims.

We claim:

1. A filling machine, for a predetermined number of filling units mounted thereon, each including pump means having two ends, one of which is actuatable, each pump means comprising pump cylinder means and pump piston means connected with piston rod means, and separate actuating drive means on the same side of the machine for the filling units of the same side, characterized in that for purposes of increasing the number of filling stations on the same filling machine, the respective separate drive means of the same side are drivingly interconnected by a linking bar carrying a predetermined number of bearing sleeve means corresponding in number to the desired increased number of filling units to be used on the same side, a mounting bar detachably connected with said filling machine and carrying a number of pump post means corresponding to said increased number, and the linking bar and its bearing sleeve means being all actuated in unison by the thus interconnected separate drive means, whereby the number of filling units can be increased to said predeterimed increased number by operatively connecting one end of each filling unit to a corresponding pump post means on the mounting bar and the other actuatable end thereof to a corresponding bearing sleeve means.

2. A filling machine according to claim 1, characterized in that the separate drive means each includes a rotatable eccentric pin, and in that the linking bar is provided with apertures fitting over the eccentric pins of two separate drive means.

3. A filling machine according to claim 2, characterized in that one of said apertures is circular and the other one is elongated.

4. A filling machine according to claim 2, characterized in that the bearing sleeve means are threadably secured on said linking bar and in that said pump post means are threadably secured on said mounting bar.

5. A filling machine according to claim 4, characterized in that said mounting bar is threadably secured in holes originally provided in the filling machine for fastening thereto pump post means for the original filling units.

6. A filling machine according to claim 1, characterized in that the bearing sleeve means are detachably secured on said linking bar and in that said pump post means are detachably secured on said mounting bar.

7. A filling machine according to claim 1, characterized in that said mounting bar is detachably secured in holes originally provided in the filling machine for fastening thereto pump post means for the original filling units.

8. A conversion kit for converting a filling machine having a first number of filling units into a filling machine with a second number of filling units larger than said first number substantially without change in the machine itself, characterized in that said converter kit includes two bars for at least two original filling units which are to be increased in number, one of said bars being a linking bar for detachably interconnecting separate drive means for the two original filling units and carrying a number of bearing sleeve means corresponding to said greater number to thereby enable actuation in unison of said greater number of filling units, the other bar being a mounting bar to be detachably secured on said filling machine and carrying a number of pump post members corresponding to said greater number, said bearing sleeve means and pump post member being so spaced on the respective bar as to enable installation of said larger number of filling units between respective pump post members and bearing sleeve means while enabling simultaneous actuation thereof.

9. A conversion kit according to claim 8, characterized in that said linking bar is provided with apertures to enable detachable mounting thereof over eccentric actuating pins of the separate drive means.

10. A converter kit according to claim 9, characterized in that said mounting bar is adapted to be threadably secured on said machine in holes provided for pump post members supporting thereon original filling units before their removal.

11. A converter kit according to claim 10, characterized in that each pump post member is provided with a threaded section for threadably connecting the same onto the mounting bar in a corresponding threaded bore thereof.

12. A converter kit according to claim 11, characterized in that said linking bar is provided with a number of threaded bores, and threaded means for connecting said bearing sleeve means to said linking bar by engagement with the threaded bores thereof.

13. A converter kit according to claim 12, characterized in that each bearing sleeve means includes a separate bushing.

14. A converter kit according to claim 8, characterized in that said mounting bar is adapted to be threadably secured on said machine in holes provided for pump post members supporting thereon original filling units before their removal.

15. A converter kit according to claim 8, characterized in that each pump post member is provided with a threaded section for threadably connecting the same onto the mounting bar in a corresponding threaded bore thereof.

16. A converter kit according to claim 8, characterized in that said linking bar is provided with a number of threaded bores, and threaded means for connecting said bearing sleeve means to said linking bar by engagement with the threaded bores thereof.

17. A converter kit according to claim 16, characterized in that each bearing sleeve means includes a separate bushing.

18. A method for converting a filling machine having a first number of original filling units mounted at one end on support means and drivingly connected at the other with separate drive means, into a filling machine having a second number of filling units greater than said first number, comprising the steps of disconnecting the original filling units from their respective drive means and disassembling the same from their support means, removing the original support means, interconnecting separate drive means by a linking member carrying a number of bearing sleeves equal to the second number of filling units, detachably connecting to the machine in lieu of the mounting support means at least one bar carrying a number of mounting members equal to said second greater number, and operatively connecting opposite ends of a respective filling unit to a corresponding mounting member and bearing sleeve, whereby a number of filling units equal to said greater number can be installed on said machine and driven in unison by said linking member.

19. A method according to claim 18, wherein said bar is detachably connected to said machine by using the holes in said machine which were provided to connect thereto the support means.

* * * * *